US011460280B2

(12) United States Patent
Thomas

(10) Patent No.: US 11,460,280 B2
(45) Date of Patent: Oct. 4, 2022

(54) FIRING MECHANISM FOR A GRENADE AND A GRENADE

(71) Applicant: Alliance Development Group Ltd, Worcestershire (GB)

(72) Inventor: Duncan Thomas, Worcestershire (GB)

(73) Assignee: Alliance Development Group Ltd, Worcestershire (GB)

( * ) Notice: Subject to any disclaimer, the term of this patent is extended or adjusted under 35 U.S.C. 154(b) by 0 days.

(21) Appl. No.: 17/114,099

(22) Filed: Dec. 7, 2020

(65) Prior Publication Data

US 2021/0285749 A1 Sep. 16, 2021

(30) Foreign Application Priority Data

Dec. 5, 2019 (GB) ..... 1917798

(51) Int. Cl.
*F42C 1/04* (2006.01)
*F42B 27/00* (2006.01)
(Continued)

(52) U.S. Cl.
CPC ..... *F42C 1/04* (2013.01); *F42B 27/00* (2013.01); *F42C 14/02* (2013.01); *F42C 15/21* (2013.01);
(Continued)

(58) Field of Classification Search
CPC ..... F42B 8/26; F42B 27/00; F41H 13/0087; F41H 13/0081; F42C 15/21; F42C 14/02; F42C 1/04
(Continued)

(56) References Cited

U.S. PATENT DOCUMENTS 1,481,635 A * 1/1924 Councilman ..... F42C 1/06 102/260
9,846,019 B1 * 12/2017 Graf ..... F42C 14/02
(Continued)

FOREIGN PATENT DOCUMENTS

GB 102279 A 11/1916

OTHER PUBLICATIONS

Search report dated May 26, 2021 for GB2019250.6 (3 pages).

*Primary Examiner* — John Cooper
(74) *Attorney, Agent, or Firm* — Patterson Intellectual Property Law, PC; Emily A. Shouse

(57) ABSTRACT

A grenade firing mechanism 12 has a body 18 defining an internal chamber 32 in which a firing pin structure 40 is located. The firing pin structure is actuated by an inertia toggle 64 having a first end contained within the chamber and a second end region 72 which projects from the body. A safety lever 16 is releasably mounted to the second end region 72 of the inertia toggle in an operative position to prevent the inertia toggle moving to actuate the firing pin structure. A lever spring 104 is operative to eject the lever from the inertia toggle allow the firing pin structure to be actuated when the grenade is deployed. The lever 16 carries an abutment pin 120 which extends through the body to engage the firing pin structure 40 to inhibit the firing pin structure moving in a firing direction when the lever is in its operative position. The inertia toggle may have a convex abutment surface which engages the firing pin structure. The firing mechanism is particularly suited to a sound flash distraction grenade.

23 Claims, 7 Drawing Sheets

(51) Int. Cl.
*F42C 14/02* (2006.01)
*F42C 15/21* (2006.01)
*F41H 13/00* (2006.01)

(52) U.S. Cl.
CPC ..... *F41H 13/0081* (2013.01); *F41H 13/0087* (2013.01)

(58) Field of Classification Search
USPC ..... 102/368, 482, 498, 272
See application file for complete search history.

(56) References Cited

U.S. PATENT DOCUMENTS

| | | | | |
|---|---|---|---|---|
| 2007/0283833 | A1* | 12/2007 | George Ellis | F42B 27/08 102/498 |
| 2018/0135954 | A1* | 5/2018 | Thomas | F42C 15/44 |
| 2018/0283836 | A1 | 10/2018 | Thomas | |
| 2018/0313640 | A1 | 11/2018 | Thomas | |

* cited by examiner

FIRING MECHANISM FOR A GRENADE AND A GRENADE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: GB 1917798.9 filed Dec. 5, 2019.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to a firing mechanism for a grenade and to a grenade incorporating such a firing mechanism. The present invention relates in particular, but not exclusively, to a firing mechanism for a sound flash distraction grenade and to a sound flash distraction grenade.

Hand grenades are known which contain a charge that is set off when the grenade is thrown. Such grenades may be lethal or non-lethal. Lethal grenades include fragmentary grenades which have an explosive charge contained in a housing that fragments when the charge is detonated so as to cause physical harm to personal and equipment in the vicinity. Non-lethal grenades include sound flash grenades, sometimes also referred to as stun grenades or distraction devices. These are generally intended for use by law enforcement and military personnel to physiologically and psychologically stun an intended victim in high-risk situations but without causing significant physical damage. Known sound flash distraction grenades generally comprise a housing containing a deflagrating pyrotechnic charge and a detonation mechanism with a small time delay. When detonated, sound flash grenades emit a loud noise, a pressure wave and a flash of light to stun the intended victim but without expelling matter that might cause physical injury to the intended victim or anyone else in the vicinity. It is also known to provide training grenades that contain only a small primer charge and which can be used to practice deployment of explosive and/or sound flash grenades.

Unless expressly stated otherwise, the term "grenade" as used herein, and in particular in the claims, is intended to encompass all types of hand grenade, including lethal explosive grenades and non-lethal sound flash distraction grenades and practice grenades.

Grenades comprise a firing mechanism for setting off the charge when the grenade is thrown. In one known arrangement, the grenade houses a primer charge that is set off when struck by a firing pin. The primer charge is often used to ignite a fuze which sets off a main charge after a short time delay. In a common firing mechanism used for grenades, a striker plate with a firing pin is resiliently biased by a spring to a firing position in which the firing pin contacts the primer charge. The plate is initially held in a non-firing position in which the firing pin is spaced from the primer charge against the bias force by means of a release lever. The firing arrangement will usually also include a removable safety pin for holding the lever in a non-release position where it extends adjacent the body of the grenade. To fire the grenade, a user grasps the grenade in one hand holding the leaver on to the body of the grenade to hold the striker plate in its non-firing position. The user removes the safety pin with the other hand and then throws the grenade. This releases the lever which is moved away from the body by the spring acting on the striker plate allowing the striker plate to move to the firing position to contact the primer charge.

US 2007/0283833 A1 discloses an alternative firing mechanism for a training grenade in which a firing pin is moved to strike a primer charge by means of an inertia toggle. The toggle is mounted in the body of the grenade with a head region at one end projecting out of the body and is attached to the firing pin by a ball and socket joint at the other end. The toggle has a substantial mass and is able to pivot and move axially inwardly relative to the body. The firing pin is biased by a spring to hold the pin and toggle in a non-firing, safe position. When the grenade is thrown and hits a solid surface, the toggle is caused to pivot and/or move axially inwardly which moves the firing pin against the spring bias to strike the primer charge. In some cases, the grenade may land on the toggle which is moved inwardly of the body to actuate the firing pin. Alternatively, the body of the grenade may hit the surface, in which case the inertia of the toggle causes it to move axially inwardly and/or to pivot relative to the body and actuate the firing pin. In one embodiment, the toggle is held in the non-firing position by means of a lever. The lever defines a recess in which the head region of the toggle is received and extends adjacent the body of the grenade in manner similar to the release lever in a conventional grenade. A spring is operative between a base of the recess in the lever and the toggle to bias the lever away from the toggle and the lever is held in position on the toggle by a removable safety pin. When using the grenade with the lever fitted, the safety pin is removed whilst the user holds the lever against the body of the grenade. When the grenade is thrown, the lever is ejected clear of the toggle by the spring, leaving the toggle free to move and actuate the firing pin as described above. The use of a lever to prevent the toggle moving from its non-firing position is particularly beneficial for a training grenade as the method of using the grenade remains similar to that of a conventional grenade so far as the user is concerned.

Whilst the inertia toggle type firing mechanism disclosed in US 2007/0283833 A1 works well, the sensitivity of the firing mechanism determines the impact force required to detonate the primer charge. If the toggle mechanism is not sufficiently sensitive, the grenade may not detonate if thrown from a low deployment height. On the other hand, if the firing mechanism is too sensitive there is a risk that the grenade may be detonated unintentionally.

It would be desirable to provide an inertia toggle type firing mechanism for a hand grenade having an increased sensitivity over the known arrangements.

It would be desirable to provide an inertia toggle type firing mechanism for a hand grenade which can be configured to provide a desired level of sensitivity.

It would also be desirable to provide an inertia toggle type firing mechanism for a hand grenade which has an increased level of safety to reduce the risk of inadvertent detonation.

BRIEF SUMMARY OF THE INVENTION

According to an aspect of the invention, there is provided a firing mechanism for a grenade, the firing mechanism comprising a body defining at least one internal chamber, a firing pin structure located within the chamber and movable in use from an initial, non-firing position in a firing direction, and an inertia toggle actuator mechanism for actuating the firing pin structure; wherein the inertia toggle has a first end region contained within the chamber and a second end region which projects from the body, the first end region of the inertia toggle having an abutment surface in abutment with the firing pin structure, the firing pin structure being biased towards the non-firing position at which it is operative to hold the inertia toggle in a neutral position; the inertia toggle being movable in use relative to the body away from the neutral position to move the firing pin from its non-firing position in said firing direction against the bias force; the firing mechanism having a safety lever releasably mounted to the second end region of the inertia toggle in an operative position and configured to inhibit movement of the inertia toggle relative to the body from its neutral position, a lever spring operative to eject the lever from the inertia toggle and a safety pin releasably engaging both the lever and the second end region of the toggle to retain the lever on the toggle against the bias force of the lever spring, the lever carrying an abutment member which extends through the body to engage the firing pin structure to inhibit the firing pin structure from moving in the firing direction from its non-firing position when the lever is mounted to the second end region of the inertia toggle in the operative position.

The abutment member acts as a secondary deadlock to prevent the firing mechanism moving in the firing direction to actuate a charge in the grenade whist the safety lever is in place and so provides an additional level of safety.

In an embodiment, the abutment surface of the inertia toggle is convex. The abutment surface of the inertia toggle may be generally hemispherical. The abutment surface of the inertia toggle may comprise a central projection or nipple surrounded by a generally hemispherical region. The convex abutment surface of the inertia toggle may comprise a central region and an outer region, the central region having a higher degree of curvature than the outer region. The outer region may be generally frustro-hemispherical.

In an embodiment, the second end region of the inertia toggle projects from the body at one end and the lever has a first portion defining a recess for receiving at least part of the second end region of the inertia toggle and a second portion which extends adjacent a side of the body when in the operative position, the arrangement being such that in use, the second portion of the lever can be held against the body by a user to retain the lever in the operative position when the safety pin is removed. The second end region of the inertia toggle may comprise a head slidably received in the recess defined by the first portion of the lever, the lever engaging the body to inhibit the inertia toggle from moving relative to the body from its neutral position. The head may act as a pivot weight of the toggle actuator.

In accordance with a further aspect of the invention, there is provided a firing mechanism for a grenade, the firing mechanism comprising a body defining at least one internal chamber, a firing pin structure located within the chamber and movable in use from an initial, non-firing position in a firing direction, and an inertia toggle actuator mechanism for actuating the firing pin structure; wherein the inertia toggle has a first end region contained within the chamber and a second end region which projects from the body, the first end region of the inertia toggle having an abutment surface in abutment with the firing pin structure, the firing pin structure being biased towards the non-firing position at which it is operative to hold the inertia toggle in a neutral position; the inertia toggle being movable in use relative to the body away from the neutral position to move the firing pin from its non-firing position in said firing direction against the bias force; wherein the abutment surface of the inertia toggle is convex.

The profile of the convex curved abutment surface of the toggle actuator determines the degree of annular tilt the toggle must undergo in order to move the firing pin structure sufficiently to detonate a charge in the grenade. Accordingly, this profile can be configured to provide a desired level of sensitivity of the firing mechanism. The profile of the convex curved abutment surface may be configured to produce a non-linear relationship between the angular movement of the toggle away from the neutral position and the axial movement of the firing pin. The abutment surface of the toggle actuator may be configured so that the toggle moves through at least 60% or at least 70% of its maximum range of angular movement from the neutral position before the firing pin is moved axially in the firing direction.

The abutment surface of the inertia toggle may be generally hemispherical. The abutment surface of the inertia toggle may comprise a central projection or nipple surrounded by a generally hemispherical region. The convex abutment surface of the inertia toggle may comprise a central region and an outer region, the central region having a higher degree of curvature than the outer region.

In a firing mechanism according to either aspect of the invention as set out above, the convex abutment surface of the inertia toggle may engage a substantially planar surface of the firing pin structure.

In a firing mechanism according to either aspect of the invention as set out above, the firing pin structure may comprise an annular bush slidably received within the chamber and a firing pin located in an aperture of the bush, the firing pin projecting beyond the bush at a side opposite the toggle for engagement with a primer charge in use. The bush may be made of a relatively light-weight material. The bush may be made of a polymeric material. The bush may be made from nylon. In a firing mechanism according to the aspect of the invention first set out above, the abutment member on the lever may engage with the bush when the lever is mounted to the toggle in its operative position.

In accordance with a further aspect of the invention, there is provided a grenade having a firing mechanism in accordance with either aspect of the invention set out above.

The grenade may comprise a munitions compartment releasably mountable to the body for holding a charge to be actuated by the firing pin in use. The munitions compartment may define an internal chamber for receiving a cartridge to be actuated by the firing pin in use. In an embodiment, the internal chamber of the munitions compartment is configured to hold a cartridge of a first size, the grenade comprising an adaptor removably mountable in the internal chamber of the munitions compartment, the adaptor defining an internal chamber for holding a cartridge of a different size. The grenade may be a sound flash distraction grenade.

BRIEF DESCRIPTION OF THE SEVERAL VIEWS OF THE DRAWINGS

In order that the invention may be more clearly understood some example will now be described, by way of example only, with reference to the accompanying drawings, of which.

DETAILED DESCRIPTION OF THE INVENTION

Figure 2:
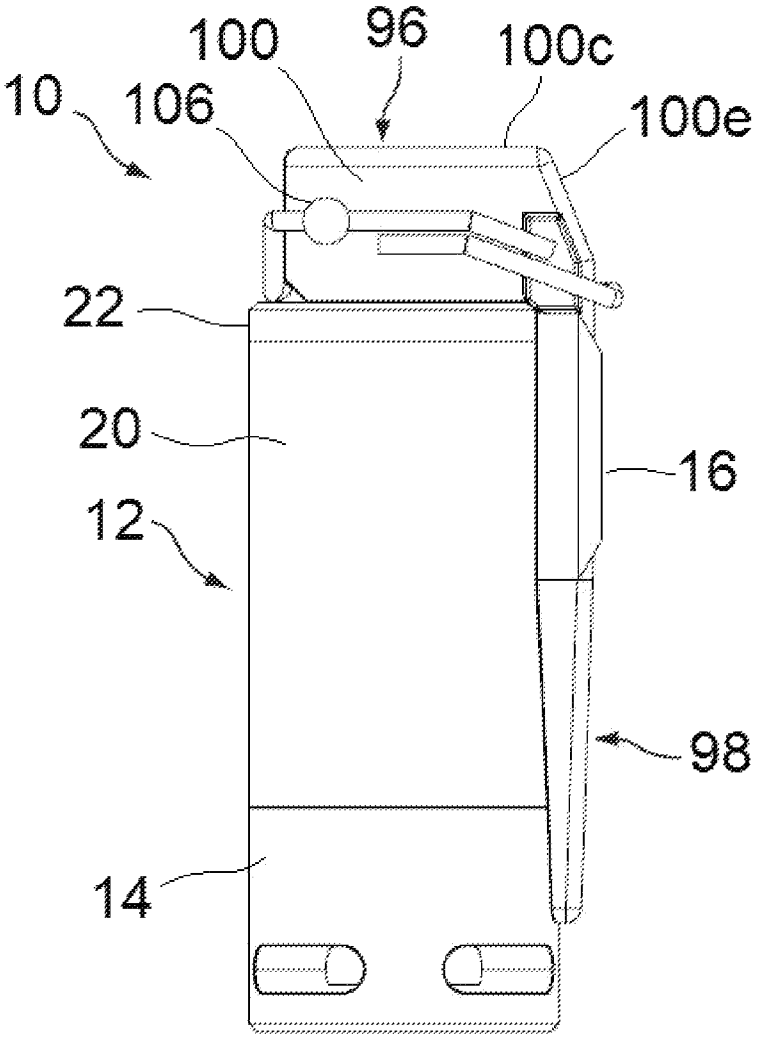
FIG. 2 is a side view of the sound flash distraction hand grenade of FIG. 1.
Figure 1:
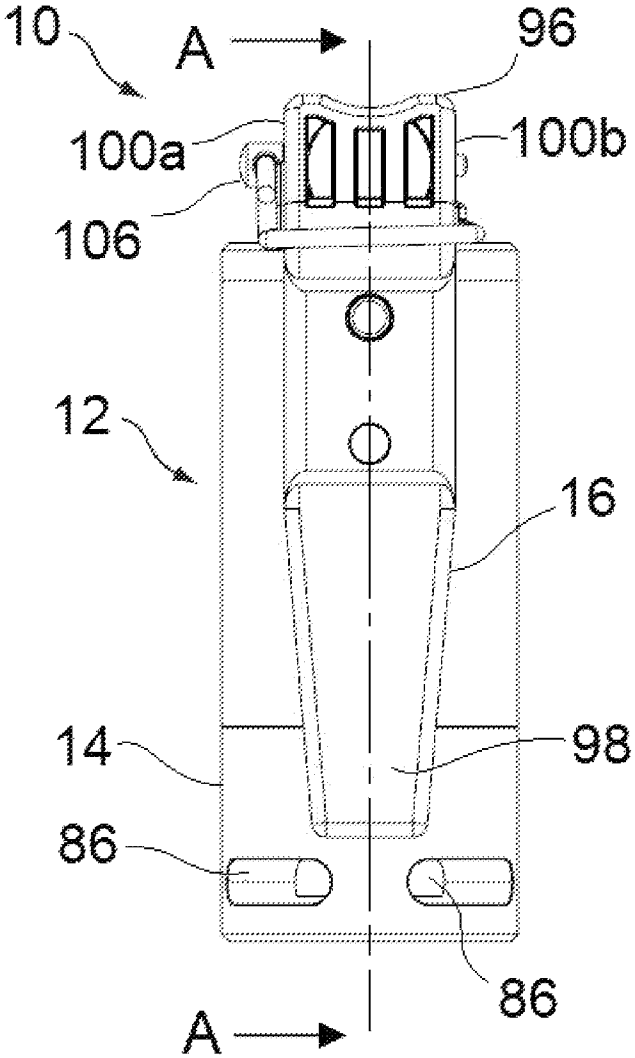
FIG. 1 is a front view of a first example of a sound flash distraction hand grenade having a firing mechanism.
Figure 3:
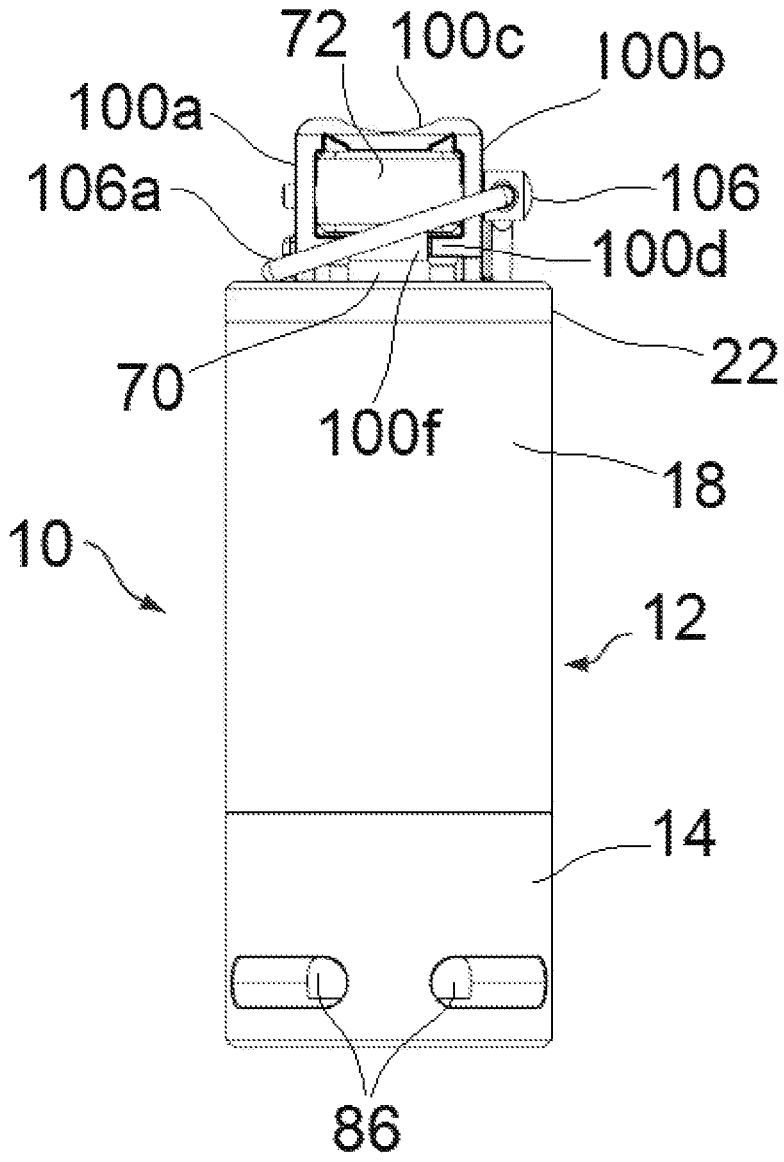
FIG. 3 is a rear view of the sound flash distraction hand grenade of FIG. 1.

Referring to FIGS. 1 to 3, an example of a sound flash distraction type hand grenade or device 10 in accordance with aspects of the invention comprises a firing mechanism (indicated generally at 12), a munitions compartment 14 releasably mounted to the firing mechanism, and a safety lever 16. The munitions compartment 14 is adapted to hold a cartridge containing a primer charge, a fuze and a deflagrating pyrotechnic charge. In use, the firing mechanism is operative to actuate the primer charge which ignites the fuze, which in turn ignites the pyrotechnic charge after a delay.

Figure 4:
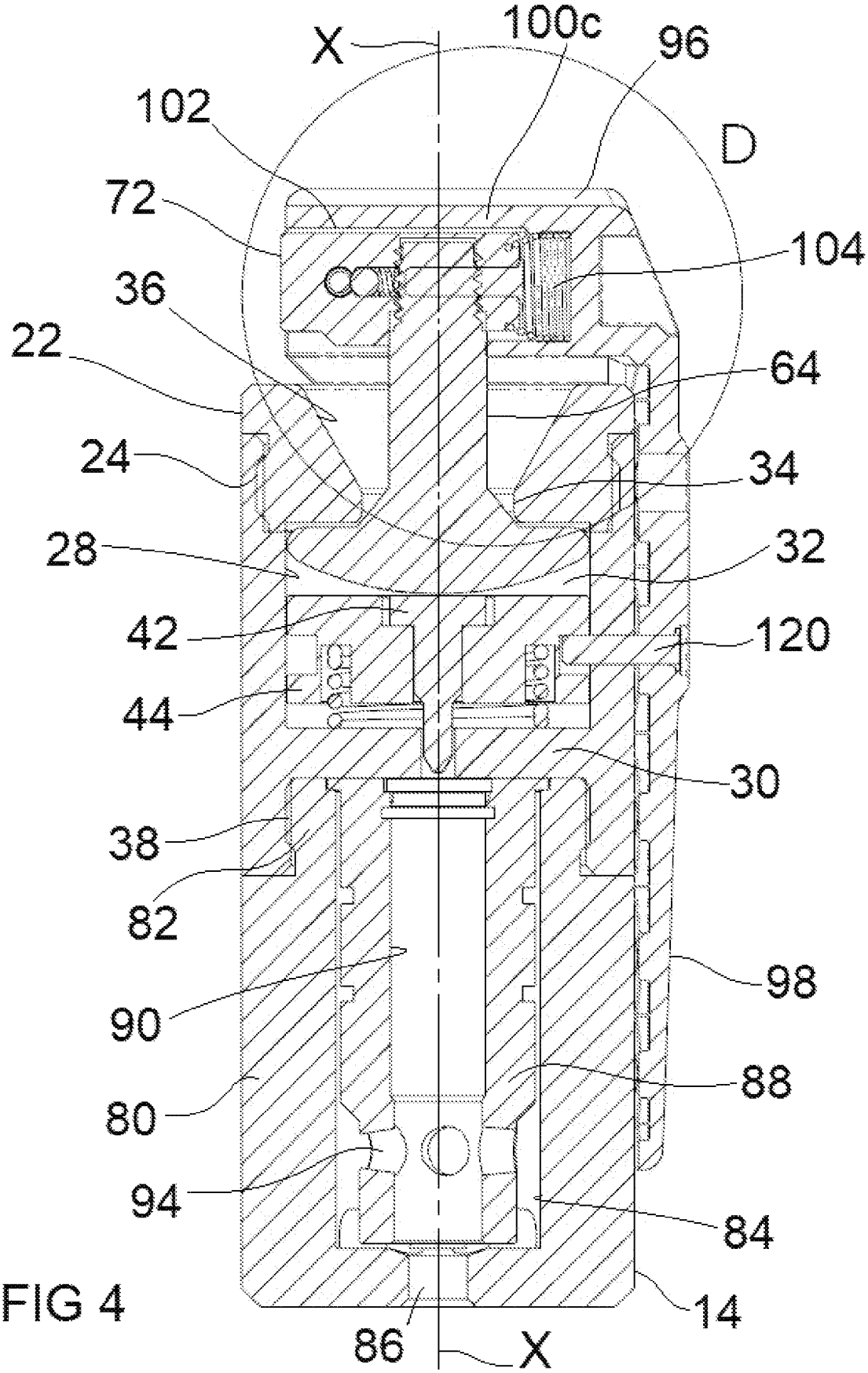
FIG. 4 is a cross-sectional view through the grenade of FIG. 1 taken on line A-A.

Referring to FIG. 4, the firing mechanism 12 has a body 18 comprising a generally cylindrical main body member 20 and an end cap 22. The main body member 20 has a first end (the upper end as viewed in the drawing) and a second end (the lower end as viewed in the drawing). The end cap 22 is removably mounted to the first end of the main body member 20 by means of a screw thread 24. The munitions compartment 14 is mounted to the second end of the main body member 20.

The main body member 20 has an annular cylindrical wall 26 defining an inner bore 28 and a partition wall 30 extending across and partially closing the bore 28. The partition wall 30 may be disposed approximately midway along the length of the main body member 20. The end cap 22 is mounted to the cylindrical wall 26 at first end (upper end as viewed in the drawings) of the main body member by the thread 24. An internal chamber 32 is defined within the inner bore 28 between the end cap 22 and the partition wall 30. The end cap 22 has a central aperture 34 which includes a conical, countersink region 36 on the outside which tapers radially outwardly towards the outer end face of the end cap. An internal thread 38 is provided on the inner surface of the cylindrical wall 26 where it projects from the partition wall 30 in the direction away from the end cap 22 and first end of the main body member 20. The internal thread 38 may extend from the partition wall 30 to a position close to the second end of the main body member 20. The internal thread 38 is provided to enable the attachment of the munitions compartment 14 to the main body member. The main body member 20 and the end cap 22 can be made of any suitable materials, including metallic materials such as aluminium, an aluminium alloy, or stainless steel.

Figure 7:
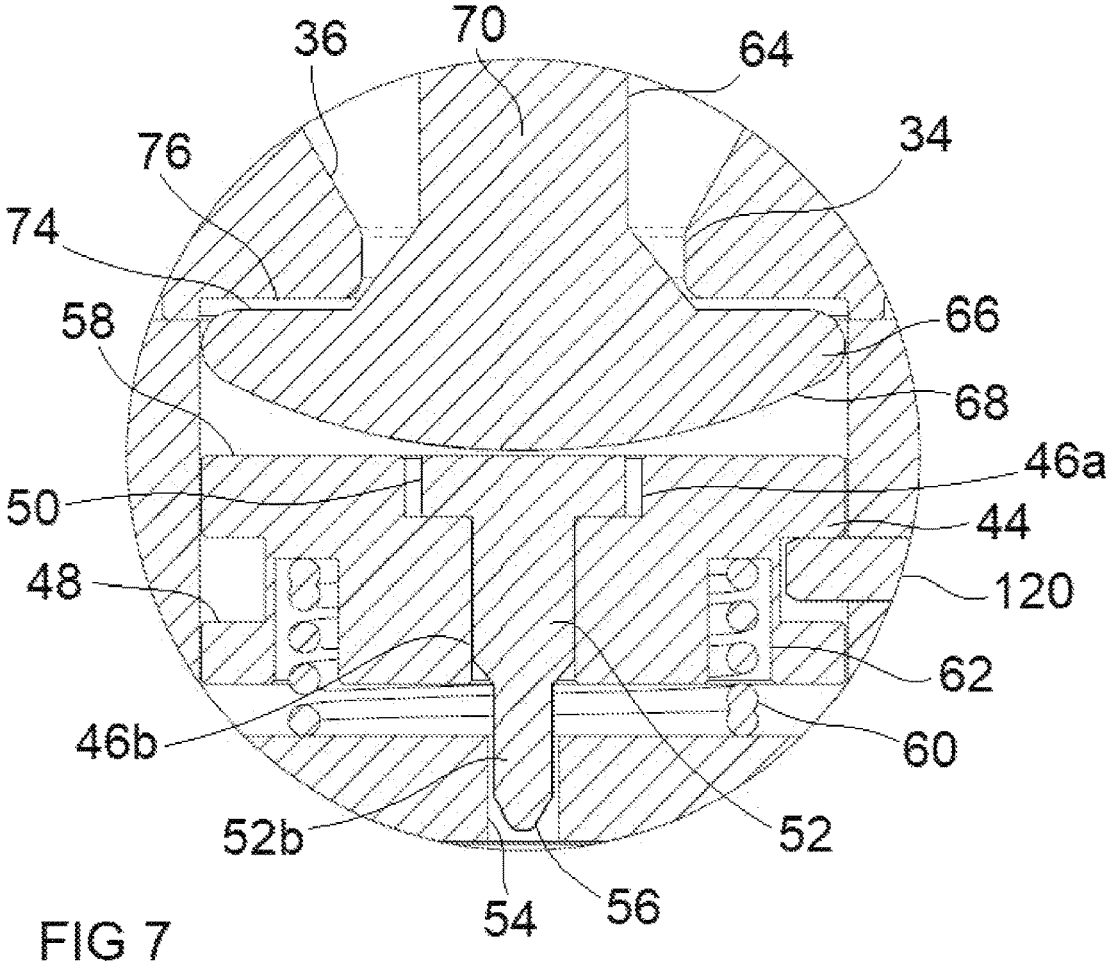
FIG. 7 is a view on an enlarged scale of a still further detail part of the grenade of FIG. 3.
Figure 8:
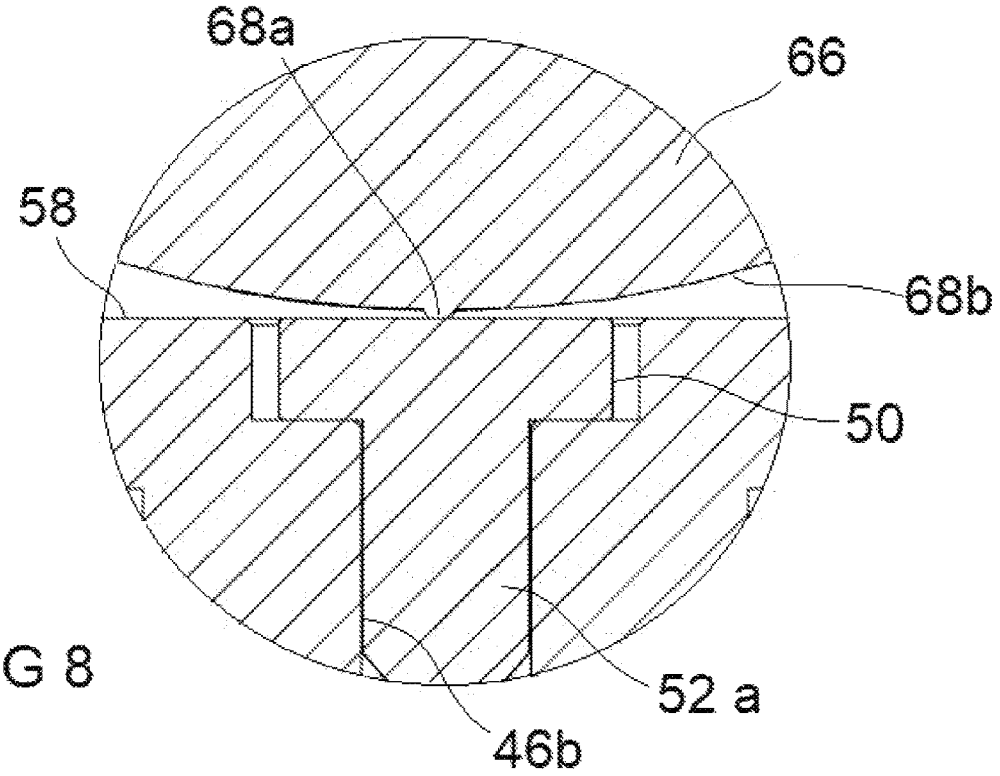
FIG. 8 is a view on an enlarged scale of a yet further detail part of the grenade of FIG. 3 showing corresponding abutment surfaces of an inertia toggle and a firing pin structure forming part of the firing mechanism.

A firing pin assembly 40 is mounted within the internal chamber 32. The firing pin assembly 40 comprises a firing pin 42 and a bush 44 slidably received within the inner bore 28 of the body 18. As best seen in FIG. 7, the bush 44 is annular, having a central aperture 46 in which the firing pin 42 is mounted. The outer diameter of the bush 44 is a close sliding fit in the inner bore 28 so that sliding movement of the bush 44 within the internal chamber 32 is guided by the annular cylindrical wall 26. A circumferential groove 48 extends about the outer periphery of the bush 44. The central aperture 46 is stepped, having a larger diameter portion **46*a* at a first end which is proximal the end cap 22 and a smaller diameter portion 46*b* which extends through to the opposite end of the bush. The firing pin 42 has a head portion 50 which locates in the larger diameter portion 46*a* of the central aperture 46 and a spigot 52 which projects centrally from the head portion through the smaller diameter portion 46*b* of the central aperture. The firing pin spigot 52 is stepped, having a larger dimeter region 52*a* which is a close sliding fit in the smaller diameter portion 46*b* of the central aperture and a smaller diameter portion which projects beyond the bush 44 and extends through a central aperture 54 in the partition wall 30. The free end 56 of the firing pin spigot 52 is tapered to a near point and configured to contact and actuate a primer charge in a cartridge located in the munitions compartment 14. The bush 44 and the head portion 50 of the firing pin have co-planar end surfaces that face towards the end cap 22 to define a planar abutment surface 58 of the firing pin structure 40**.

A helical compression spring 60 is operative between the partition wall 30 and the bush 44 to bias the firing pin assembly 40 away from the partition wall towards an initial, non-firing position in which the free end 56 of the firing pin spigot 52 is spaced from the primer charge of a cartridge mounted in the munitions compartment 14. The bush 44 has an annular groove 62 in a lower face in which one end of the spring 60 engages. When unconstrained, the firing pin assembly 40 can be moved from its initial non-firing position in a firing direction (as indicated by arrow B in FIG. 4) against the bias force of the spring 60 to bring the free end 56 of the firing pin into contact with the primer charge of the cartridge mounted in the munitions compartment 14.

The bush 44 can be made of any suitable material and may be made of a polymeric material such as nylon. The firing pin 42 can be made of any suitable material. In some examples, the firing pin 42 is made of a metallic material such as stainless steel.

The firing mechanism 12 includes an inertia toggle actuator 64 for actuating the firing pin assembly 40. The inertia toggle actuator 64 has a first end region located inside the internal chamber 32 of the body 18 and a second end region which projects out of the body 18. The first end region defines an abutment member 66 having a convex, generally hemispherical abutment surface 68 which engages the planar abutment surface 58 of the firing pin structure 40. The abutment member 66 has an outer diameter which is larger than the central aperture 34 in the end cap 22 but slightly smaller than that of the inner bore 28 of the main body member 20. A central shaft 70 projects from the abutment member 66 through the aperture 34 in the end cap 22 to define the second end region and carries a head 72 at its free end. The head 72 is shaped generally as a rectangular cuboid or parallelepiped and is located on the shaft off-set towards one end. The head 72 may be formed as a component separate from the shaft 70 and is mounted on the shaft by means of a screw threaded connection. To this end, an external thread is formed on a free end of the shaft 70 which engages with a corresponding internal thread formed in a shaft bore 73 extending through the head 72. Once the head 72 is mounted to the shaft 70, it is pinned or otherwise fixed to the shaft in a predetermined position so that it cannot be unscrewed from the shaft. The head 72 can be made of any suitable material but preferably has a significant mass as it acts as a pivot weight for the inertia toggle actuator 64. The head 72 may be made of a metallic material such as stainless steel.

The abutment member 66 has an annular, planar surface region 74 surrounding the shaft 70 on its side opposite from the abutment surface 68 and a corresponding opposing planar surface region 76 is provided on the inner side of the end cap 22 surrounding the central aperture 34. When the firing pin assembly 40 is held in its initial non-firing position by the spring 60, it engages the abutment member 66 of the inertia toggle actuator 64 such that the annular, planar surface region 74 of the abutment member is held in abutment with opposing planar surface region 76 of the end cap 22. This will be referred to as a neutral position of the inertia toggle actuator 64, in which the axis of the shaft 70 is co-axial with a longitudinal axis X of the firing mechanism body 18 and the munitions compartment 14.

The firing mechanism 12 is configured such that when the inertia toggle actuator 64 is unconstrained it is able to move from its neutral position inwardly relative to the body 18 in an axial direction against the bias force of the spring 60. This moves the firing pin assembly 40 axially in the firing direction B (FIG. 4) to contact and actuate the primer charge of the cartridge in the munitions compartment 14. The unconstrained inertia toggle actuator 64 is also able to pivot relative to the body 18 so that the axis of the shaft 70 is off-set from the axis X of the body 18. When the toggle 64 is tilted relative to the axis of the body 18, the planar surface region 74 of the abutment member remains in contact with the opposing planar surface region 76 of the end cap on one side and the abutment member 66 is moved axially away from the end cap 22 on the opposite side. This also has the effect of moving the firing pin assembly 40 axially in the firing direction B.

The profile of the convex curved abutment surface 68 determines the degree of angular tilt the inertia toggle actuator 64 must undergo in order to move the firing pin assembly 40 sufficiently to detonate the primer charge. Accordingly, this profile can be modified to optimise the sensitivity of the firing mechanism. For example, depending on the shape of the convex curved abutment surface 68, the rate of movement of the firing pin assembly 40 relative to the inertia toggle actuator 64 can be either linear or non-linear. A linear relationship between movement of the inertia toggle 64 and movement of the firing pin 42 tends to be less sensitive as the firing pin starts its movement towards the primer as the inertia toggle actuator starts to move. However, the abutment surface 68 can be configured so that the relationship between angular movement of the inertia toggle actuator 64 away from the neutral position and the resultant axial movement of the firing pin 42 is non-linear. Thus, the abutment surface of the inertia toggle actuator can be configured to provide a multi-stage camming action whereby the movement of the inertia toggle actuator relative to the main body cause respective different rates of acceleration of the firing pin when moving from the non-firing to the firing position.

In the illustrated example, the convex abutment surface 68 comprises two distinct convex regions, a small diameter central region 68*a* surrounded by an outer region 68*b*. The degree of curvature is significantly higher in the central region 68*a* than in the surrounding outer region 68*b* so that the central region 68*a* defines a projection or nipple which engages the abutment surface 58 of the firing pin assembly 40 when the inertia toggle actuator 64 is in its neutral position. The inertia toggle actuator 64 is able to pivot about the central region 68*a* over a significant range of its angular movement away from the neutral position without moving the firing pin 42 axially in the firing direction B, at least to any significant extent, before the outer region 68*b* of the abutment surface contacts the abutment surface 58 of the firing pin assembly 40. Once the outer region 68*b* of the abutment surface 68 engages the abutment surface 58 of the firing pin assembly 40, further tilting of the inertia toggle actuator 64 causes the firing pin assembly 40 to move axially in the firing direction B to actuate the cartridge in the munitions chamber 14. The abutment surface 68 may be configured so that the inertia toggle actuator 64 moves sideways (tilts) by at least 60% or at least 70% of its maximum range of angular movement from the neutral position before the firing pin 42 is moved towards the primer by any significant amount. This allows the inertia toggle actuator 64 to build up momentum prior to moving the firing pin assembly 40, producing rapid acceleration of the firing pin 42 towards the end of the inertia toggle actuator's travel. This is particularly beneficial at low drop heights. Tests have indicated that the firing mechanism can be optimised so that the sound flash grenade is reliably discharged when deployed from a height as low as 0.78 cm (7 inches) if dropped whilst in a horizontal orientation (i.e. with the axis X aligned horizontally) and 2.54 cm (1 inch) if dropped in a vertical orientation (i.e. with the axis X aligned vertically). The profiled convex shape of the abutment surface 68 allows the impact force of the grenade impacting against a hard surface to transfer maximum inertia through to the firing pin 42 in the most optimised and efficient manner possible allowing the grenade to be discharged at very low deployment heights.

The munitions compartment 14 is generally cylindrical and may comprise a main body portion 80 with an outer diameter substantially the same as that of the cylindrical wall 26 of the main body member 20 of the firing mechanism 12. An externally threaded flange 82 at one end of the munitions compartment 14 has a smaller dimeter than the main portion 80 and engages with the internal thread 38 on the cylindrical wall 26 of the main body member 20 of the firing mechanism 12 to mount the munitions compartment 14 to the firing mechanism. The munitions compartment 14 defines a central blind bore 84 which is open towards the firing mechanism 12 and partially closed at the other end. The bore 84 defines an internal chamber for receiving the cartridge. The munitions compartment 14 has one or more openings 86 which connect the bore 84 to atmosphere through which a flash of light, sound and pressure given off by the deflagrating pyrotechnic charge when it is ignited can pass. The bore 84 may be configured to hold a cartridge of a first size and the grenade may include an adaptor 88 which is removably received in the bore 84 to enable a smaller cartridge to be used. The adaptor 88 may be a generally cylindrical member having an inner bore 90 which is stepped to define a first region 92 which defines an internal chamber dimensioned to receive the smaller cartridge. Openings 94 extend through the adaptor 88 to connect the bore 90 with atmosphere through the bore 84 and/or the openings 86 in the munitions compartment body 80. This enables a flash of light, sound and pressure given off by a cartridge held in the adaptor 88 to pass out from the munitions compartment 14 when the adaptor is used. The grenade can be used with or without the adaptor 88 depending on the size of cartridge required. In alternative examples, the grenade 10 does not have an adaptor 88.

Having a munitions compartment 14 which is releasably mounted to the firing mechanism 12 enables the grenade 10 to be loaded and reloaded after use so that it can be used multiple times. The grenade 10 can also be loaded with different types cartridges, enabling the grenade to be used for different applications requiring different types of pyrotechnic charge and/or fuze to create different effects and/or different time delays. However, in alternative examples, a munitions compartment may be formed integral with the firing mechanism.

In use, when a cartridge is mounted in the munitions compartment 14 and the munitions compartment is mounted to the firing mechanism 12, the grenade 10 is deployed by throwing the grenade so that it comes into contact with a hard surface. The impact when the grenade comes into contact with the hard surface causes the inertia toggle actuator 64 to move the firing pin assembly 40 in the firing direction B to actuate the primer charge in the cartridge. The primer charge ignites the fuze, which after a delay ignites the pyrotechnic charge. The firing mechanism 12 can be actuated in a number of ways. If the head 72 of the inertia toggle actuator 64 impacts a hard surface this will cause the inertia toggle actuator 64 to move axially inwardly of the firing mechanism body 18 and/or to tilt relative to the axis of the body to move the firing pin assembly 40 in the firing direction and actuate the primer charge. If the firing mechanism body 18 and/or the munitions compartment 14 hits a hard surface, the inertia of the toggle head 72 will cause the inertia toggle actuator 64 will cause it to move axially inwardly of the firing mechanism body 18 and/or to tilt relative to the axis of the body to move the firing pin assembly 40 in the firing direction and actuate the primer charge.

The safety lever 16 is operative to prevent the grenade 10 being actuated inadvertently. The safety lever 16 is mounted to the head 72 of the inertia toggle actuator 64 in an operative position in which it prevents the inertia toggle actuator 64 moving from its neutral position but is ejected from the toggle when the grenade 10 is deployed so that the inertia toggle actuator 64 is free to move from its neutral position and actuate the firing pin assembly 40.

Referring to FIGS. 1 to 3, the safety lever 16 has first and second portions 96, 98. The first portion 96 comprises a housing 100 which defines a recess 102 in which the head 72 of the inertia toggle actuator 64 is slidably received when the safety lever 16 is in its operative position. The housing 100 substantially surrounds the head 72 on five sides but is open at a rear, first end. The housing 100 has opposed side walls 100*a*, 100*b* which locate on either side of the head 72, an upper wall 100*c* which extends between the side walls 100*a*, 100*b* and locates above the head 72, a lower wall 100*d* which locates below the head and a front-end wall 100*e*. The side walls 100*a*, 100*b*, the upper wall 100*c* and the lower wall 100*d* project from the front end wall 100*e*. The lower wall 100*d* has a slot 100*f* to through which the shaft 70 projects.

Figure 5:
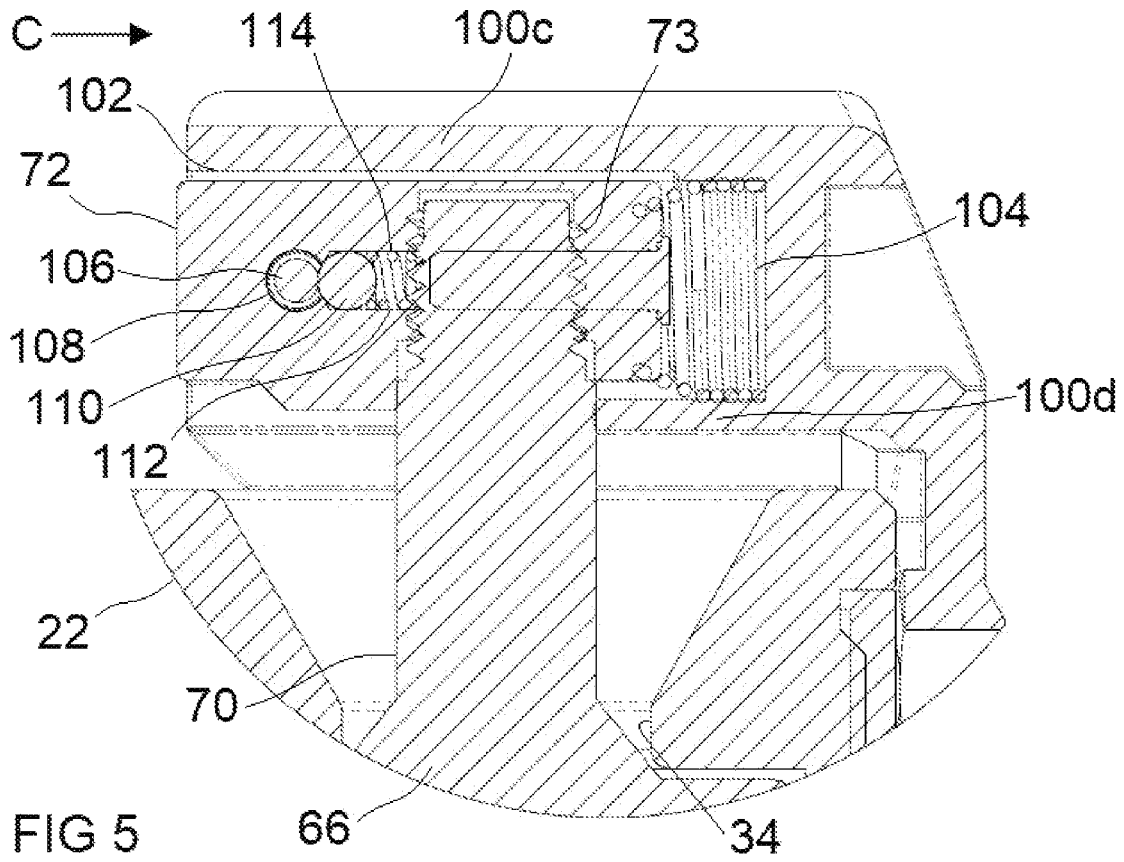
FIG. 5 is a view on an enlarged scale of detail D in FIG. 4.
Figure 6:
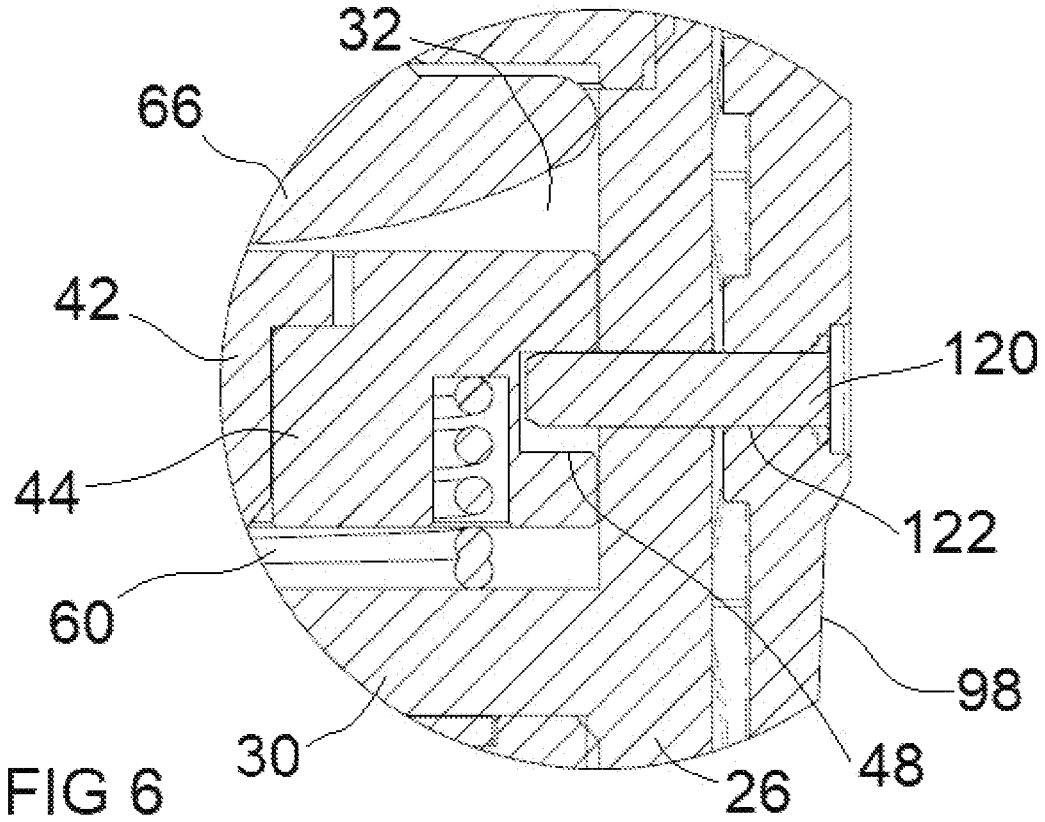
FIG. 6 is a view on an enlarged scale of a further detail part of the grenade of FIG. 4.

The second portion 98 of the safety lever 16 is an elongate member which extends from the housing 100 at the closed end. The first and second portions 96, 98 of the safety lever 16 are angled relative to one another so that when the safety lever is mounted to the toggle head 72 in the operative position, the second portion 98 of the safety lever extends adjacent a side of the firing mechanising body 18. A safety lever spring 104 is located in the housing 100 in compression between an end of the head 72 and the front-end wall 100*e* of the housing 100. The safety lever spring 104 is operative to bias the safety lever 16 away from the toggle head 72 (in the direction of arrow C in FIG. 5) so that the safety lever 16 is ejected if not held in its operative position. A safety pin 106 is removably inserted though aligned holes in opposite side walls of the lever housing 100 and a through safety pin bore 108 in the toggle head 72 to hold the safety lever in its operative position against the bias force of the safety lever spring 104. In the illustrated example, a locking ball 110 is located in a further bore 112 in the head 72 which extends orthogonally to the safety pin bore 108 from the shaft bore 73 to partially break through into the safety pin bore 108. A locking ball spring 114 is located in the further bore 112 between the locking ball 110 and the shaft 70 and is operative to bias the locking ball to the end of the further bore 112 so that part of the locking ball 110 projects into the safety pin bore 108. The safety pin 106 has a recessed region in its outer surface which aligns with the locking ball 110 when the safety pin is fully inserted. The locking ball 110 locates in the recessed region to releasably hold the safety pin 106 in position. However, the safety pin 106 can be removed by applying sufficient force to overcome the bias force of the locking ball spring 114 to depress the locking ball 110.

Whilst the safety lever 16 is held in the operative position, the inertia toggle actuator 64 is inhibited from moving from its neutral position and so is inoperative. To deploy the grenade 10, a user grasps the grenade 10 in one hand to hold the second portion 98 of the safety lever 16 in contact with the body 18 of the firing mechanism 14 and removes the safety pin 106. So long as the user holds the second portion 98 of the lever against the grenade body in the operative position, the inertia toggle 64 remains inoperative. The user then throws the grenade 10, releasing the safety lever 16. The safety lever spring 104 biases the safety lever 16 away from the inertia toggle head 72 so that the safety lever 16 is ejected, becoming fully separated from the remainder of the grenade 10, and the inertia toggle actuator 64 is freed to actuate the firing pin assembly 40 as described above.

As shown in FIGS. 1 to 3, the safety pin 106 may be provided with a ring 106*a* or other feature that can be grasped to pull the safety pin 106 out. This allows the grenade 10 to be deployed by a user using both hands, one to grasp the grenade 10 and hold the safety lever 16 in place and the other to remove the safety pin 106. However, in alternative examples, the grenade may be configured for use with a grenade holder such as that disclosed in U.S. Pat. No. 8,651,347 B1 (sold and marketed by ACS Industries Limited as the "Trigger Pouch" RTM). In this arrangement, the grenade 10 is releasably held in a pouch or holder, which is worn by the user and the safety pin 106 is attached to the pouch or holder by a tether. A user is able to release the grenade 10 from the pouch or holder by grasping the grenade 10 in one hand to hold the safety lever 16 against the firing mechanism body 18 in the operative position and pulling the grenade free from the pouch. As the grenade 10 is moved out of the pouch, the safety pin 106 is automatically removed by means of the tether and the user can throw the grenade 10, releasing the safety lever 16 which is ejected. This arrangement enables the grenade 10 to be deployed single handed and very quickly.

Whilst the safety lever 16 prevents the inertia toggle actuator 64 from actuating the firing pin assembly 40 when in its operative position, because the firing pin assembly 40 and the actuator toggle 64 are not mechanically tied to one another, there is a risk that the firing pin assembly 40 could move away from the inertia toggle actuator 64 in the firing direction from its non-firing position in the event that sufficient force is applied, say due to the grenade 10 being dropped or shaken. This could potentially result in the grenade 10 being detonated even with the safety lever 16 in place. The risk of this happening can be reduced by minimising the mass of the firing pin assembly 40, for example by making the bush 44 from a lightweight material. However, this issue may be further addressed in the grenade 10 by a secondary safety feature to lock the firing pin assembly 40 in its non-firing position when the safety lever 16 is in its operative position.

The secondary safety feature comprises a firing pin assembly engager 120 that engages the firing pin assembly 40 to inhibit actuation of the firing pin assembly by the inertia toggle actuator 64. The firing pin assembly engager 120 may comprise an abutment member 120 provided on the safety lever 16, which engages the firing pin assembly 40 to lock it in its non-firing position when the safety lever 16 is in its operative position. The abutment member 120 may be in the form of a pin which projects from an inner surface of the second portion 98 of the safety lever 16 through an aperture 122 in the cylindrical wall 26 of the firing mechanism body 18 and engages in the circumferential groove 48 in the periphery of the firing pin assembly bush 44 when the safety lever 16 is in its operative position. This physically prevents the firing pin assembly 40 from moving in the firing direction B from its non-firing position whilst the safety lever 16 is in its operative position. When the grenade 10 is deployed and the safety lever 16 ejected, the abutment pin 120 is withdrawn with the safety lever so that the firing mechanism is free to actuate the primer charge in the cartridge in the manner previously described. The abutment pin 120 may be integrally formed as part of the safety lever 16 or it may be a separate item which is affixed to the safety lever 16. The safety lever 16 may be moulded from polymeric materials and the abutment pin 120 may be a metallic pin which is an interference fit in an aperture in the second portion 98 of the safety lever. However, this is not essential. An abutment member 120 other than a pin could be used and the abutment member 120 could be arranged to co-operate with any suitable feature of the firing pin assembly 40 to lock it in its non-firing position. The abutment member 120 could locate beneath the bush 44 for example or engage in a hole or recess in the bush 44 other than a circumferential groove. It should also be appreciated that the firing pin assembly 40 may take other forms from that shown in FIGS. 1 to 8. For example, the firing pin and bush could be formed as a single integral component from a suitable material or the firing pin could be mounted to the bush in a different manner.

A second example of a sound flash distraction type hand grenade or device 210 in accordance with aspects of the invention is shown in FIGS. 9 to 12. Features of the grenade 210 similar to or identical to features of the grenade 10 will be referenced by the same reference numerals incremented by 200 and may not be described in detail again. The grenade 210 comprises a firing mechanism (indicated generally at 212), a munitions compartment 214 releasably mounted to the firing mechanism, and a safety lever 216. The principal differences between the grenade 10 and the grenade 210 reside in the firing pin assembly 410.

The firing pin assembly 410 comprises a firing pin 412, a brake element 414 that engages the firing pin when the firing pin is in the non-firing position, a holding element 416 that holds the brake element in engagement with the firing pin and a biasing element 418 configured to provide a biasing force to drive the firing pin to the firing position. In the illustrated example, the holding element 416 is hollow cup-like body that defines a brake chamber having an internal wall that defines a brake holding portion 420 and a brake release portion 422. The brake holding portion 420 may be disposed at the open, or outer end, of the brake chamber and is configured to hold the brake element 414 in engagement with the firing pin 412 when the firing pin is in the non-firing position. The brake release portion 422 may be disposed at the closed, or inner, end of the brake chamber and be configured to allow movement of the brake element 414 away from the firing pin 412 to release the firing pin and so that it may move from the non-firing position to the firing position. In the illustrated example, the brake holding portion 420 is a circumferentially extending surface that has a first diameter and the brake release portion 422 is another circumferentially extending surface that has a second diameter that is greater than the first diameter so as to define a circumferentially extending groove, or recess, between the brake holding portion 420 and a wall 424 that defines a closed end of the brake chamber. The wall 424 also defines an abutment surface 426 of the firing pin assembly 410 that is engaged by the inertia toggle actuator 264. In other examples, the brake release portion 422 may comprise a discrete recess configured to at least partially receive the brake element 414. However, a circumferentially extending groove is considered preferable to avoid alignment issues during assembly and use.

The firing pin assembly 410 may further comprise a housing 428 disposed in the main body 220 in the internal chamber 232. The housing 428 may be a cylindrical member having a side wall provided with external threading 430 by which the housing 428 can be secured in the internal chamber 232. The housing 428 defines an axially extending firing pin chamber 432. The firing pin 412 is disposed in the firing pin chamber 432 and is movable in the firing pin chamber between the non-firing position shown in the FIG. 9 and the firing position shown in FIG. 11. A downstream end wall of the housing 428 is provided with an aperture 434 through which the free end 436 of the firing pin 412 may project into the munitions compartment 214. The firing pin chamber 432 may have a diameter slightly larger than the diameter of the firing pin 412 to provide a sliding fit so that the firing pin is guided by the lengthways extending side wall of the firing pin chamber 432 when it moves between the non-firing and firing positions.

The biasing element 418 is arranged to act between the holding element 416 and the firing pin 412 and may comprise a compression spring at least partially received in the firing pin chamber 432. The biasing element 418 may have one end received in a bore provided in the trailing end of the firing pin 412 and a spigot 442 projecting into the brake chamber from the wall 424. The bore 440 and spigot 442 are configured to provide support for the biasing element to prevent twisting or kinking so that the bias force acting on the firing pin 412 is at least substantially expended only in driving the firing pin from the non-firing to the firing positions.

The brake element 414 may be a ball partially housed in a through-hole 446 provided in the lengthways extending side wall of the housing 428. The through-hole 446 may be configured such that the brake element 414 can be moved in a direction transverse of the firing direction of the firing pin 412 when moving away from the firing pin into the brake release portion 422 to release the firing pin. A side wall of the firing pin 412 may be provided with a recess 450 (FIG. 11) to partially receive the brake element 414 in order to facilitate the engagement of the brake element with the firing pin.

Figure 9:
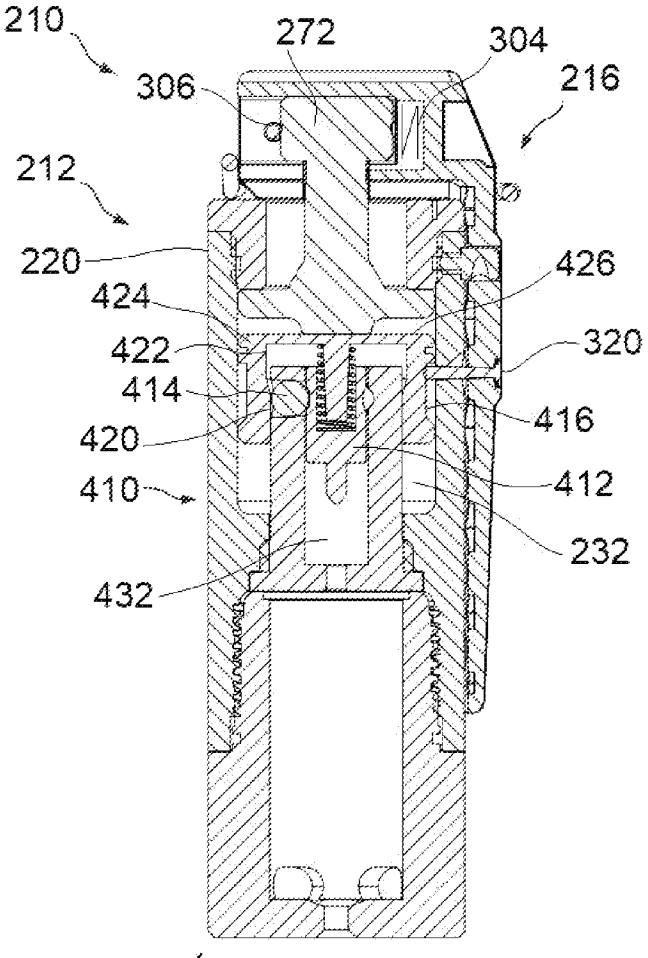
FIG. 9 is a section view of a second example of a sound flash distraction hand grenade having a firing mechanism shown in a non-firing condition.
Figure 11:
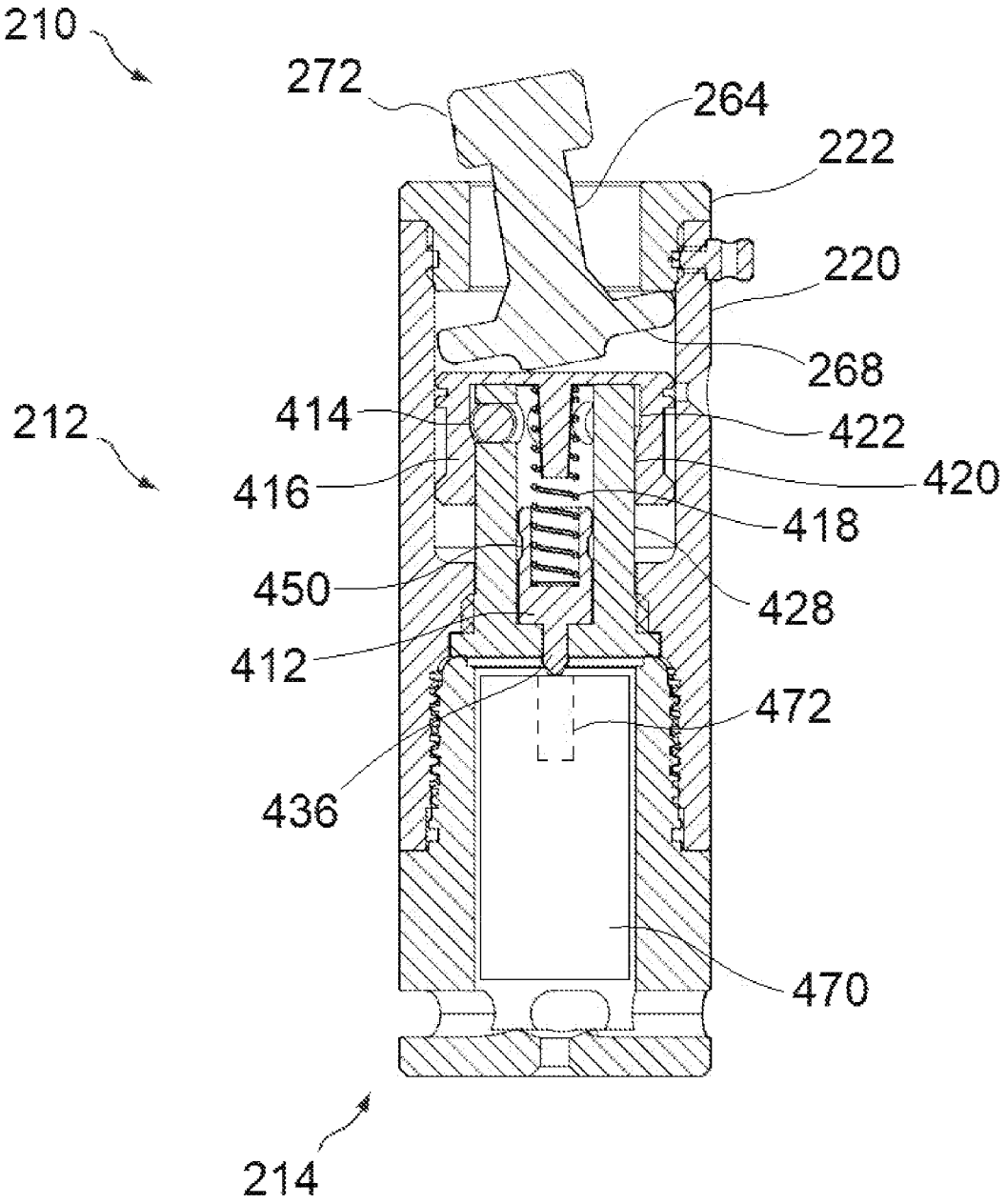
FIG. 11 is a section view of the sound flash distraction hand grenade of FIG. 9 in a firing condition.

In this example, the firing pin assembly engager 320 is an abutment member carried by the safety lever 216 that passes through a through-hole provided in the main body 220 to engage the holding element 416. The holding element 416 may be provided with a discrete recess or a circumferentially extending groove to facilitate engagement with the firing pin assembly engager 320. Engagement of the firing pin assembly engager 320 with such a circumferentially extending groove is shown in FIG. 9.

Although the inertia toggle actuator 64 shown in FIGS. 1 to 8 may be used in the grenade firing mechanism 212, in the illustrated example, a modified inertia toggle actuator 264 is used. Instead of having a curved abutment surface 68, the abutment surface 268 has generally planar central region 268*a* that is raised with respect to a generally planar outer region 268*b* so that it projects from the plane of the outer region. It is to be understood that the modified inertia toggle actuator 264 may be used in the grenade 10 in place of the inertia toggle actuator 64.

The munitions chamber 214 is a body that can be screw fitted to the main body 220 in similar fashion of the munitions chamber 14 of the grenade 10. In this example, the end of the munitions chamber 214 closest to the firing pin assembly 410 is closed by an end wall of the housing 428 and the firing pin 412 is able to enter the munitions chamber 214 via the aperture 434 provided defined by the housing, rather than through an aperture provided in a partition wall of the main body as in the grenade 10.

The munitions chamber 214 may be configured to hold a cartridge 470 (shown schematically in FIG. 11) comprising a primer charge 472. In some examples, the chamber may be configured to hold a blank cartridge or just a primer charge. In similar fashion to the grenade 10, the munitions compartment 214 may be configured to receive a relatively large cartridge and one or more adapters that can be fitted into the munitions compartment to house one or more smaller sizes of cartridge or just a primer charge.

The grenade 210 is shown in a secured condition in FIG. 9 suitable for transport and storage. The firing pin 412 is held in a non-firing position by the brake element 414 engaged in the recess 450 in the firing pin and trapped between the firing pin and the brake holding portion 420 of the holding element 416. The engagement of the brake element 414 with the firing pin 412 resists the biasing force exerted by the biasing element, which would otherwise act to drive the firing pin from the non-firing position to the firing position. The firing pin assembly 410 is held in position by the firing pin assembly engager 320 engaging the holding element 416. The abutment of the abutment surface 426 of the holding element 416 with the abutment surface 268 and the safety lever 216 maintain the inertia toggle actuator 264 in the neutral position shown in FIG. 9.

Figure 10:
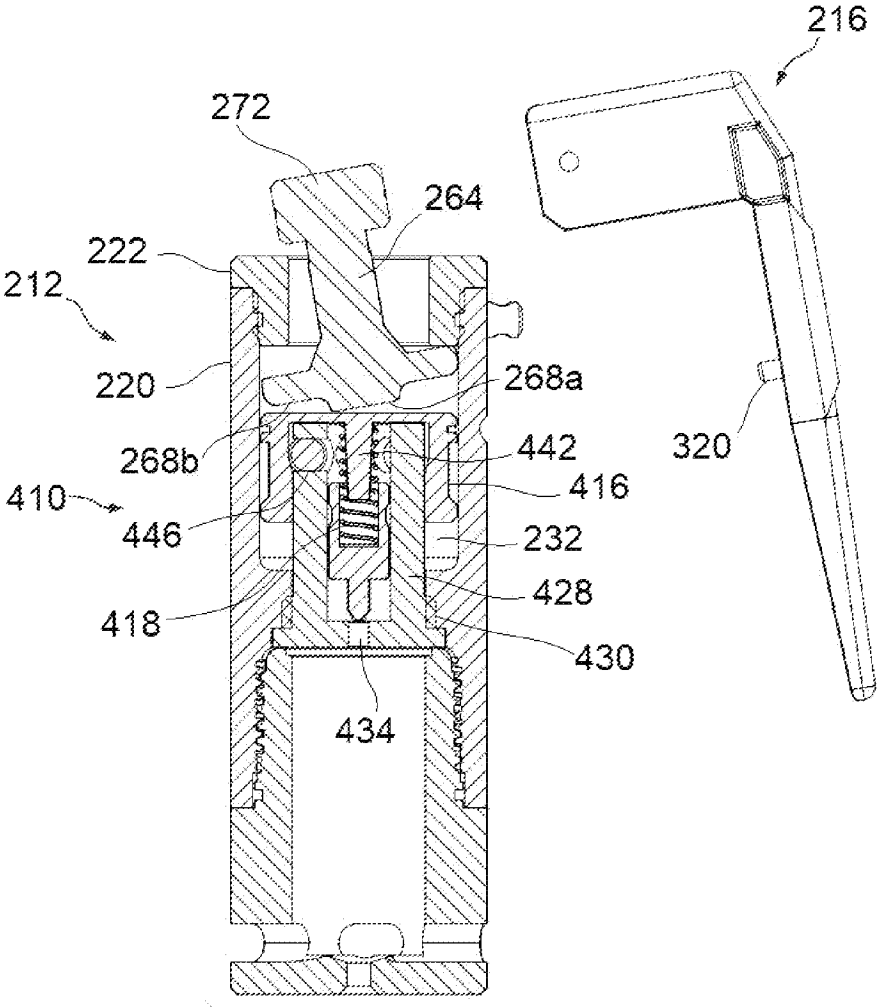
FIG. 10 is a is a section view of the sound flash distraction hand grenade of FIG. 9 with a safety lever ejected.

When a user wishes to deploy the grenade 210, they remove the safety pin 306 while holding the safety lever 216 against the main body 220. At this stage the inertia toggle actuator 264 is still held in the neutral position shown in FIG. 9 and the firing pin assembly engager 320 still engages the holding element 416. When ready, the user throws the grenade 210, thereby releasing their grip on the safety lever 216 which is ejected from the head 272 of the inertia toggle actuator 264 under the influence of the lever spring 304. As shown in FIG. 10, the ejection of the safety lever 216 disengages the firing pin assembly engager 320 freeing the holding element 416. When the grenade 210 lands, the inertia toggle actuator 264 moves relative to the main body 220 from the neutral position shown in FIG. 9. The pivoting movement of the inertia toggle actuator 264 and abutment of the abutment surface 268 with the abutment surface 426 of the holding element 416 drives the holding element towards the munitions chamber 214. As the holding element 416 is moved by the inertia toggle actuator 264, the brake holding portion 420 is moved out of engagement with the brake element 414 and the brake release portion is moved to a position opposite the brake element, or the through-hole 446 in which it is housed. This at least reduces the resistance to the biasing force applied to the firing pin 412 by the biasing element 418 so that the firing pin can push the brake element 414 back into the brake release portion 422 as shown in FIG. 10, thereby releasing the firing pin. The firing pin 412 is then free to move under the influence of the biasing element 418 to the firing position shown in FIG. 11 in which the leading end 436 of the firing pin enters the munitions chamber 214 via the aperture 434 to actuate the primer charge 472 disposed in the munitions chamber.

The firing mechanism 412 is described above as having one brake element 414 housed in through-hole 446. It will be understood that there may be a plurality of brake elements 414, for example three of four, mounted in respective through-holes 446 disposed in equi-distance spaced apart relationship about the lengthways extending side wall of the housing 428.

The firing mechanisms 12, 212 and safety levers 16, 216 are designed to ensure that the safety lever is reliably ejected when the grenade 10, 210 is deployed. To this end, the aperture in the main body that is penetrated by the firing pin assembly engager 122, 320 may be countersunk on the outside to ensure that the firing pin assembly engager 122, 320 does not bind when the safety lever 16, 216 is ejected.

The secondary safety feature in the form of a firing pin assembly engager provides an additional deadlock to prevent the grenade 10, 210 from being actuated so long as the safety lever 16, 216 is held in its operational position mounted on the inertia toggle actuator and engaging a side of the main body 20, 220. This significantly reduces the risk of the grenade 10, 210 being inadvertently set off whilst being handled or carried by a user or during storage or transportation.

In the illustrated examples, the secondary safety feature comprises a firing pin assembly engager carried by the safety lever 16, 216. It is to be understood that this is not essential. In alternative examples, the firing pin assembly engager may be a spring-loaded member mounted in the main body 20, 220 such that a first end engages the firing pin assembly and a second end protrudes from the main body to be engaged by the safety lever 16, 216. Engagement with the safety lever 16, 216 will maintain the spring-loaded member firing pin assembly in engagement with the firing pin assembly to inhibit actuation of the firing pin assembly by the inertia toggle actuator. The safety lever 16, 216 may be provided with a raised portion or insert arranged to engage the second end of the spring-loaded member to ensure good contact between the two. When the safety lever 16, 216 is ejected by the lever spring 104, 304, the spring-loaded member can be pushed out of engagement with the firing pin assembly allowing actuation by the inertia toggle actuator in analogous fashion to the examples shown in the drawings.

The firing mechanisms 12, 212 can be made more sensitive than known inertia toggle type firing mechanisms so that they will discharge even when deployed from relatively low deployment heights. The secondary safety feature which locks the firing pin assembly 40, 410 in with the firing pin in the non-firing position until the safety lever 16, 216 is ejected, reduces the risk of the grenade 10, 210 being unintentionally discharged. However, the secondary safety feature could be omitted in certain examples.

It will be understood that when compared with the firing mechanism 12, the firing mechanism 212 is particularly sensitive and able to actuate in response to very light impacts. For example, the firing mechanism 212 may actuate when impacting a relatively soft object such as a padded, or cushioned, item of furniture. This is because the firing pin is pre-loaded by the biasing element and the inertia toggle actuator simply acts as a kinetic trigger to release the firing pin and allow the biasing element to drive the firing pin into engagement with the primer charge. The means a grenade equipped with the firing mechanism 212 will function on virtually any surface.

The firing mechanisms 12, 212 and grenades 10, 210 are easy to use. Because a grenade 10, 210 having a firing mechanism 12, 212 is deployed in a manner similar to conventional grenades with a release lever type firing mechanism, it requires less training to use for someone familiar with conventional grenades and reduces the risk of a user who may have to change between different types of grenade making an error during deployment. It is also particularly suitable for use in a training grenade.

The above-described examples are described by way of example only. Many variations are possible without departing from the scope of the invention as defined in the appended claims. For example, whilst the firing mechanisms 12, 212 described above are particularly suitable for a sound flash distraction type grenade, it could be adopted in other types of hand grenade, including lethal and other non-lethal grenades. Where a grenade is intended for single use, it may have a munitions compartment 14, 214 which is not separable from the firing mechanism 12, 212. For use as a training grenade, the munitions compartment 14, 214 may be adapted to hold only a primer charge with no deflagrating or explosive charge.

Thus, although there have been described particular embodiments of the present invention of a new and useful Firing Mechanism for a Grenade and a Grenade it is not intended that such references be construed as limitations upon the scope of this invention except as set forth in the following claims.

What is claimed is:

1. A firing mechanism for a grenade, the firing mechanism comprising:

a body defining an internal chamber;

a firing pin assembly located in the internal chamber, the firing pin assembly comprising a firing pin movable in a firing direction from a non-firing position to a firing position;

an inertia toggle actuator to actuate the firing pin assembly; and a safety lever mechanism comprising a safety lever, a safety lever spring, a safety pin and a firing pin assembly engager, wherein the inertia toggle actuator has a first end region disposed in the internal chamber and a second end region disposed externally of the body, the first end region of the inertia toggle actuator having an abutment surface in abutment with the firing pin assembly, wherein the firing pin assembly is held in an operative position in which it is operative to hold the inertia toggle actuator in a neutral position, wherein the inertia toggle actuator is movable relative to the body away from the neutral position to actuate said firing pin assembly to cause the firing pin to be moved from said non-firing position to said firing position, wherein said safety lever is releasably mounted to the second end region of the inertia toggle actuator and is configured to inhibit said movement of the inertia toggle actuator relative to the body from said neutral position, wherein said safety lever spring provides a bias force operative to eject the safety lever from the second end region of the inertia toggle actuator, wherein said safety pin releasably engages both the safety lever and the second end region of the inertia toggle actuator to retain the safety lever on the second end region of said inertia toggle actuator against said bias force of the safety lever spring, and wherein the safety lever is configured to maintain said firing pin assembly engager in engagement with the firing pin assembly to inhibit actuation of said firing pin assembly by said inertia toggle actuator when the safety lever is mounted to the second end region of the inertia toggle actuator.

2. A firing mechanism as claimed in claim 1, wherein the firing pin assembly further comprises an annular bush slidably received in the internal chamber and said firing pin is located in a central aperture of the annular bush, the firing pin projecting beyond the bush at a side opposite the inertia toggle actuator for engagement with a primer charge.

3. A firing mechanism as claimed in claim 2, wherein the firing pin assembly engager engages with the annular bush to inhibit actuation of said firing pin assembly by said inertia toggle actuator.

4. A firing mechanism as claimed in claim 2, wherein said movement of said inertia toggle actuator relative to said body from said neutral position drives said firing pin assembly in said firing direction to move said firing pin to said firing position.

5. A firing mechanism as claimed in claim 1, wherein the firing pin assembly further comprises a brake element that engages said firing pin when said firing pin is in said non-firing position, a holding element that holds said brake element in engagement with said firing pin and a biasing element configured to provide a biasing force to drive said firing pin to said firing position.

6. A firing mechanism as claimed in claim 5, wherein said abutment surface of said inertia toggle actuator is in abutment with said holding element and said movement of said inertia toggle actuator relative to said body acts to cause movement of said holding element relative to the brake element that allows said brake element to release said firing pin so that said firing pin can be moved to said firing position by said biasing force.

7. A firing mechanism as claimed in claim 6, wherein said holding member defines a brake chamber having a wall that defines a brake holding portion and a brake release portion, said brake holding portion is configured to engage said brake element when disposed opposite the brake element to hold said brake element in engagement with said firing pin when said firing pin is in said non-firing position and said movement of said holding element relative to said brake element moves brings said brake release portion to a position opposite said brake element to allow said brake element to move away from said firing pin to release said firing pin.

8. A firing mechanism as claimed in claim 5, wherein said firing pin mechanism further comprises a housing disposed in said body, said firing pin is movable in said housing between said non-firing and firing positions, an end of said housing is received in said brake chamber and said brake element is partially housed in an aperture provided in a side wall of said housing that is configured such that said brake element moves transverse to said firing direction when moving away from said firing pin to release said firing pin.

9. A firing mechanism as claimed in claim 8, wherein said biasing element is disposed in said housing to act between said holding element and said firing pin.

10. A firing mechanism as claimed in claim 5, wherein said brake element comprises a ball engageable in a recess defined in the firing pin.

11. A firing mechanism as claimed in claim 5, wherein said firing pin assembly engager engages said holding element to inhibit actuation of said firing pin assembly by said inertia toggle actuator.

12. A firing mechanism as claimed in claim 1, wherein said firing pin assembly engager comprises an abutment member mounted on said safety lever and said abutment member extends through an aperture in said body to engage said firing pin assembly.

13. A firing mechanism as claimed in claim 1, wherein the safety lever comprises a first portion defining a recess for receiving at least part of the second end region of the inertia toggle actuator and a second portion which extends adjacent a side of the body to maintain said firing pin assembly engager in engagement with said firing pin assembly, the arrangement being such that in use, the second portion of the safety lever can be held against the body by a user to retain the safety lever in in position when the safety pin is removed.

14. A firing mechanism as claimed in claim 13, wherein the second end region of the inertia toggle actuator comprises a head slidably received in the recess defined by the first portion of the safety lever, the safety lever engaging the body to inhibit the inertia toggle from moving relative to the body from its neutral position.

15. A firing mechanism as claimed in claim 1, wherein the abutment surface of the inertia toggle actuator comprises a central region and an outer region, the central region being raised with respect to the outer region.

16. A firing mechanism for a grenade as claimed in claim 15, wherein said abutment surface is convex and said central region has a higher degree of curvature than said outer region.

17. A firing mechanism as claimed in claim 1, wherein the abutment surface of the inertia toggle actuator engages a substantially planar surface of the firing pin assembly.

18. A grenade comprising firing mechanism and a munitions chamber, the firing mechanism comprising:

a body defining an internal chamber;

a firing pin assembly located in the internal chamber, the firing pin assembly comprising a firing pin movable in a firing direction from a non-firing position to a firing position;

an inertia toggle actuator to actuate the firing pin assembly; and a safety lever mechanism comprising a safety lever, a safety lever spring, a safety pin and a firing pin assembly engager, wherein the inertia toggle actuator has a first end region disposed in the internal chamber and a second end region disposed externally of the body, the first end region of the inertia toggle actuator having an abutment surface in abutment with the firing pin assembly, wherein the firing pin assembly is held in an operative position in which it is operative to hold the inertia toggle actuator in a neutral position, wherein the inertia toggle actuator is movable relative to the body away from the neutral position to actuate said firing pin assembly to cause the firing pin to be moved from said non-firing position to said firing position, wherein said safety lever is releasably mounted to the second end region of the inertia toggle actuator and is configured to inhibit said movement of the inertia toggle actuator relative to the body from said neutral position, wherein said safety lever spring provides a bias force operative to eject the safety lever from the second end region of the inertia toggle actuator, wherein said safety pin releasably engages both the safety lever and the second end region of the inertia toggle actuator to retain the safety lever on the second end region of said inertia toggle actuator against said bias force of the safety lever spring, wherein the safety lever is configured to maintain said firing pin assembly engager in engagement with the firing pin assembly to inhibit actuation of said firing pin assembly by said inertia toggle actuator when the safety lever is mounted to the second end region of the inertia toggle actuator, and wherein the munitions compartment is releasably mountable to the body for holding a primer charge to be actuated by the firing pin.

19. A grenade as claimed in claim 18, wherein the munitions compartment defines a charge holding chamber configured to hold a primer charge or a cartridge comprising a primer cartridge having a first size and the grenade further comprises an adaptor removably mountable in the charge holding chamber and the adaptor is configured to hold a primer charge or cartridge comprising a primer cartridge having a different size to said first size.

20. A grenade as claimed in claim 18, wherein the grenade is a sound flash distraction grenade.

21. A firing mechanism for a grenade, the firing mechanism comprising:

a body defining an internal chamber;

a firing pin assembly disposed in the internal chamber and comprising a firing pin that is movable in a firing direction from an initial, non-firing position to a firing position; and an inertia toggle actuator for actuating the firing pin assembly, wherein the inertia toggle actuator has a first end region disposed in the internal chamber and a second end region disposed externally of the body, wherein the first end region of the inertia toggle actuator has an abutment surface in abutment with the firing pin assembly and the firing pin assembly is held in an operative position to hold the inertia toggle actuator in a neutral position, wherein the inertia toggle actuator is movable relative to the body away from the neutral position to actuate said firing pin assembly to cause the firing pin to be moved from said non-firing position to said firing position, and wherein the abutment surface of the inertia toggle actuator is configured to define a centrally disposed first surface region and a second surface region disposed outwardly of said first region to provide a multi-stage camming action, wherein said first surface region has a first profile defining a first acceleration rate and said second surface region has a second profile that is different to said first profile and defining a second acceleration rate that is greater than said first acceleration rate, whereby said movement of said inertia toggle actuator relative to the body causes respective different rates of acceleration of said firing pin when moving from said non-firing position to said firing position.

22. A firing mechanism as claimed in claim 21, further comprising a safety lever mounted to said second end region of said inertia toggle actuator and a firing pin assembly engager engageable with said firing pin assembly, wherein said safety lever is configured to engage said body so as to inhibit movement of said inertia toggle actuator relative to the body from said neutral position and to maintain said firing pin assembly engager in engagement with said firing pin assembly to inhibit actuation of said firing pin assembly by said inertia toggle actuator.

23. A firing mechanism for a grenade, the firing mechanism comprising:

a body defining an internal chamber;

a firing pin assembly disposed in the internal chamber and comprising a firing pin that is movable in a firing direction from an initial, non-firing position to a firing position; and an inertia toggle actuator for actuating the firing pin assembly, wherein the inertia toggle actuator has a first end region disposed in the internal chamber and a second end region disposed externally of the body, wherein the first end region of the inertia toggle actuator has an abutment surface in abutment with the firing pin assembly and the firing pin assembly is held in an operative position to hold the inertia toggle actuator in a neutral position, wherein the inertia toggle actuator is movable relative to the body away from the neutral position to actuate said firing pin assembly to cause the firing pin to be moved from said non-firing position to said firing position, and wherein the abutment surface of the inertia toggle actuator is configured to comprise a first convex region defining a first acceleration rate and a second convex region defining a second acceleration rate that is different to said first acceleration rate to provide a multi-stage camming action whereby said movement of said inertia toggle actuator relative to the body causes respective different rates of acceleration of said firing pin when moving from said non-firing position to said firing position.

* * * * *